United States Patent [19]

Faull

[11] 4,257,292

[45] Mar. 24, 1981

[54] PIERCING UNITS

[76] Inventor: James K. Faull, Rte. 1, Box 156, Enon Valley, Pa. 16120

[21] Appl. No.: 98,858

[22] Filed: Nov. 30, 1979

[51] Int. Cl.[3] ..... B21D 28/34; B21D 45/08

[52] U.S. Cl. ..... 83/146; 83/559; 83/588; 83/685; 83/698

[58] Field of Search ..... 83/146, 559, 588, 685, 83/698, 140

[56] References Cited

U.S. PATENT DOCUMENTS

| | | | |
|---|---|---|---|
| 1,691,928 | 11/1928 | Hutchinson et al. | 83/146 |
| 2,427,409 | 9/1947 | Kirsch | 83/559 |
| 3,120,778 | 2/1964 | Brye | 83/146 X |

OTHER PUBLICATIONS

Pierce-All Division of Producto Machine Company, Bridgeport, Conn. pp. 2, 4, 5 of Catalog.

Toolset, Inc. Catalog HP-796, p. 1.

Toolset, Inc. Catalog LP-770, p. 1.

*Primary Examiner*—Frank T. Yost

*Attorney, Agent, or Firm*—Michael Williams

[57] ABSTRACT

The piercing unit of the present invention is a low-cost device having relatively few parts. The unit comprises a C-frame of cast iron. A hole is drilled from the top of the unit, through the top leg and part way into the lower leg. The bottom of the hole forms a seat for the lower end of the die sleeve. A punch holder slide is machined from tool steel for close-tolerance fit within the hole in the top leg. The slide has an opening extending inwardly from its lower end to receive the punch, and a threaded opening extending inwardly from its upper end to receive a stripper bolt. The punch holder slide abuts a shoulder adjacent to the inner end of the stripper bolt, and thus is backed up in its punching stroke. The punch abuts the threaded inner end of the stripper bolt and is thereby backed up in its punching stroke. Dog point set screws hold the punch assembled with the punch holder slide as the punch is being stripped from the steel it has just pierced.

7 Claims, 5 Drawing Figures

PIERCING UNITS

BACKGROUND AND SUMMARY

The art of piercing with a C-shaped unit is well known and several manufacturers have quality products of this type on the market. However, these products are expensive and complicated. The piercing unit of my invention combines low cost, quality and simplicity. The C-frame is made of cast iron and the punch holder slide is made of tool steel so friction therebetween is minimized. One hole drilled from the top and part way through the bottom provides the slideway for the punch holder slide and also the receiving recess for the die sleeve, the latter being backed up by an internal shoulder formed by the bottom of the drilled hole. The punch holder slide is backed up by a shoulder adjacent to the inner end of the stripper bolt, and the punch is backed up by the inner extremity of the stripper bolt and therefore massive design to absorb the piercing force is not necessary.

DESCRIPTION OF THE DRAWING

In the drawing accompanying this specification and forming a part of this application, there is shown, for purpose of illustration, an embodiment which my invention may assume, and in this drawing.

DESCRIPTION OF THE PREFERRED EMBODIMENT

The piercing unit specifically disclosed herein is designed to accomodate a punch having a diameter varying from 0.093 inches (about 2.38125 millimeters) to 0.390 inches (about 9.92187 millimeters) and is capable of piercing steel of a thickness varying from 0.080 inches (about 1.99 millimeters) to 0.125 inches (about 3.175 millimeters). It will be appreciated that the physical characteristics hereinafter given will vary as the punch diameter and metal thickness increase beyond the maximum given above.

Found suitable for the specific purpose is a body 10 of cast iron and which may be formed as a simple casting having a thickness of one inch (about 25.400 millimeters) with a center opening 11. In some cases a slotlike opening 12 may be formed in the molding operation while in others it may be cut by a sawing operation, in either case to provide a C-frame structure. At the present time it is preferred that the opening 12 be cut after certain operations have been performed. The body may be $8\frac{1}{4}$ inches long (about 21 centimeters) and $4\frac{1}{8}$ inches high (about 11 centimeters). The length of the gap in the body may be $5\frac{1}{2}$ inches (about 14 centimeters). Lugs 14 fore and aft of the body 10 are provided with holes to pass bolts for the purpose of securing the piercing unit in upright relation on the bed B of a press brake or flat-bed press.

Figure 1:
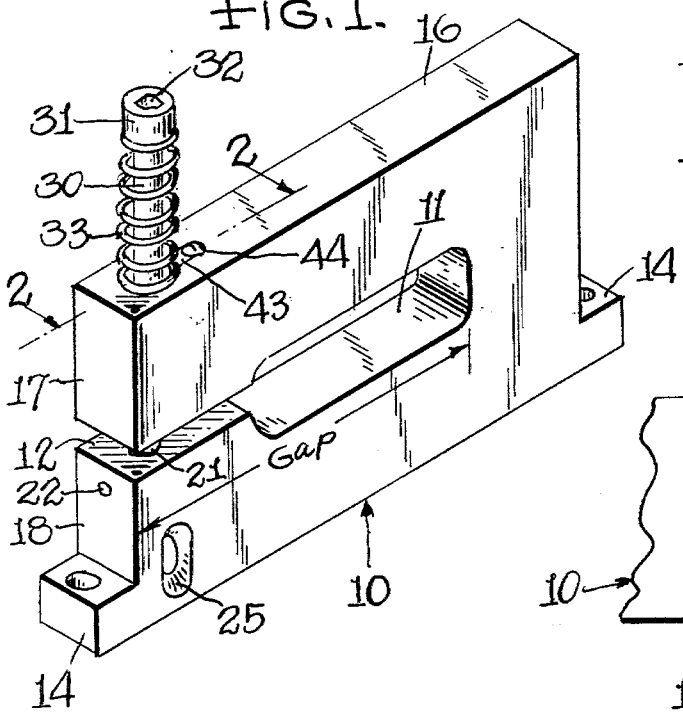
FIG. 1 is a perspective view of a piercing unit incorporating my invention.
Figure 2:
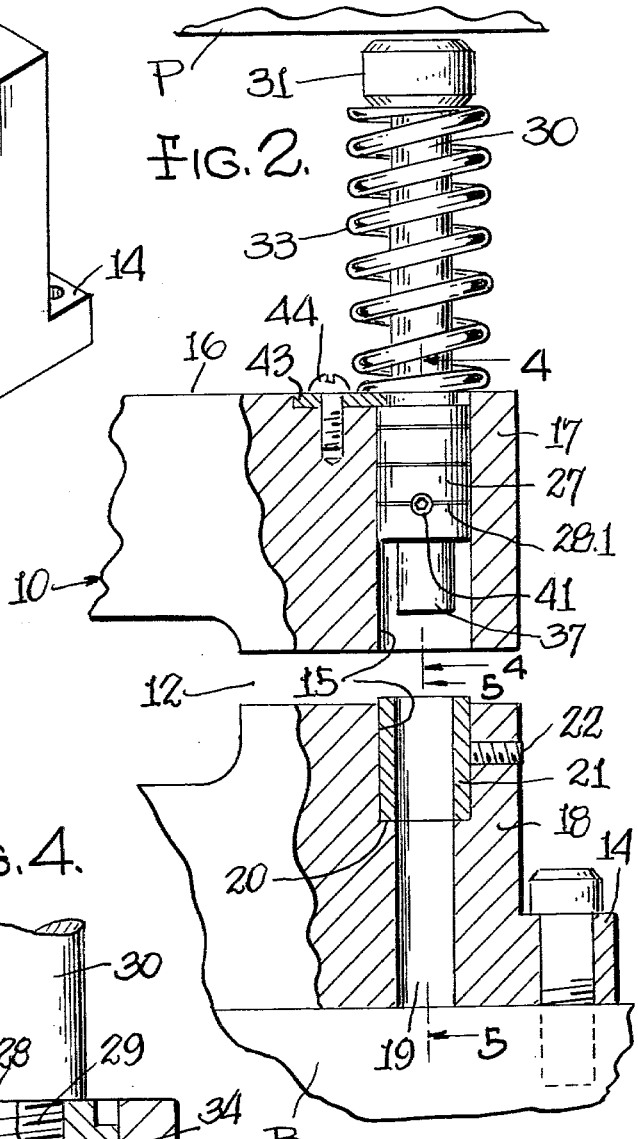
FIG. 2 is an enlarged, fragmentary side elevational view of the unit shown in FIG. 1, parts being shown in section in accordance with the line 2—2 of FIG. 1.

As seen in FIG. 2, a hole 15 is drilled from the upper surface 16 through the upper leg 17 and part way through the lower leg 18. A smaller-diameter hole 19 continues through the lower leg, to form an internal shoulder 20. In the unit specifically disclosed herein, the hole 15 is 0.625 inches (about 15.875 millimeters) and the hole 19 is 0.390 inches, the punch capacity of the unit. It is preferred that the hole 15 be drilled and reamed before the slot 12 is cut since this eliminates any misalignment that might otherwise have been caused by springing of the frame legs 17 and 18 under drilling or reaming pressure.

A die sleeve 21 of tool steel is ground to have a close-tolerance fit within the hole 15 in the lower leg and one lower end of the sleeve bottoms on the internal shoulder 20. A set screw 22 holds the die sleeve 21 against displacement upon upward movement of the punch following a piercing operation. The sleeve has an internal diameter of 0.390 inches (the maximum of the specific unit) with a tolerance to provide an operating fit with the punch. If a smaller hole is to be pierced, the internal diameter of the die sleeve would be correspondingly smaller, as would the punch diameter. Preferably, the upper end of the die sleeve extends slightly above the adjoining surface of the body slot 12. An inclined exit opening 25 communicates with the hole 19 so that slugs S resulting from the hole punching operations may be ejected.

A punch holder slide 27 of tool steel is machined and ground to slidably fit with close tolerance within the drilled and reamed hole 15 in the upper leg 17 of the C-frame. The slide 27 has a threaded opening 28 in its upper end to receive the lower threaded end 29 of a stripper bolt 30 which, in the specific embodiment, is one-half inch in diameter. The bolt has an enlarged head 31 provided with the usual recess 32 for an Allen wrench. A coil spring 33 is disposed about the stripper bolt and has its opposite ends bearing against the undersurface of the bolt head 31 and the upper surface 16 of the top leg 17 of the C-frame. The bolt 30 is threaded into the punch holder slide 27 until its shoulder 34 bears against the upper surface of the slide 27. The slide has spaced annular grooves 28.1 in its exterior which act as grease-retaining grooves.

Extending inwardly from the lower end of the punch-holder slide 27 is an opening 35 which is larger in diameter than the threaded opening 28 to form a shoulder 36 therebetween. This is a condition that exists when the holes to be pierced are of a diameter that is maximum in the specific embodiment described. If the holes are of smaller diameter, the opening 35 and punch are correspondingly smaller in diameter and, in fact, may be equal to or smaller than the diameter of the threaded end 29 of the stripper bolt. A cylindrical punch 37, of tool steel, has its upper end closely fitting into the opening 35. Downwardly from its upper end, the punch has a circumferential groove 40 for the reception of the dog point of set screws 41 (two in number in the disclosed embodiment). The set screws hold the punch 37 in position within the punch holder slide 27 and insure that the punch will elevate with the slide on stripping travel.

The upper end of the punch holder slide 27, is undercut to provide an annular shoulder 42. A small key 43 is seated within a recess formed in the upper surface 16 and has an end fitting the shoulder, and a machine screw 44 holds the key in place. The key 43 prevents the punch slide holder from being withdrawn from the opening 15 during stripping movement.

In operation, one or more piercing units are secured to the upper surface of the bed of a press brake or flat-bed press in a predetermined position. The heads 31 of the units are disposed generally within a common plane so as to be engaged by the movable platen P of the press brake or press on downward movement thereof, whereby all punches are depressed to cause the latter to coact with the respective die sleeves 21 to punch holes in the strip material which at this time is disposed flatwise in the body slot 12. The springs 33 will be compressed in this punching action, and the springs will return the stripper bolts, punch holder slides and punches to the position shown in FIG. 2 when the movable press platen P returns to its upper position.

Figure 4:
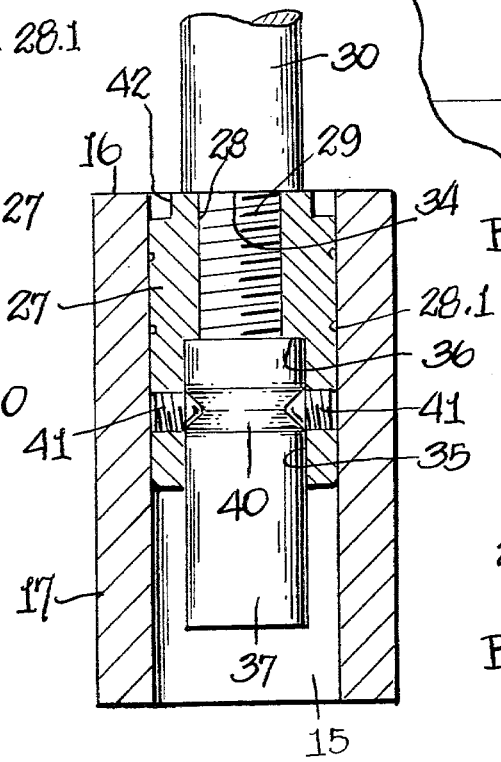
FIG. 4 is an enlarged, fragmentary sectional view corresponding to the line 4—4 of FIG. 2.
Figure 5:
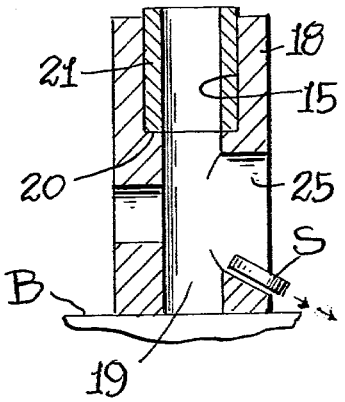
FIG. 5 is a fragmentary sectional view corresponding to the line 5—5 of FIG. 2.

It will be noted that the die sleeve 21 is solidly backed up by the shoulder 20 against the punching forces. The set screw 22 is merely for the purpose of holding the sleeve 21 against unintentional upward withdrawal from the opening 15 in the lower leg 18 of the body 10. It will also be noted that the punch holder slide 27 is solidly backed up by the shoulder 34 on the stripper bolt, and that the punch is solidly backed up by the end of the stripper bolt 30 and in some instances (such as shown in FIG. 4) also by the shoulder 36.

Figure 3:
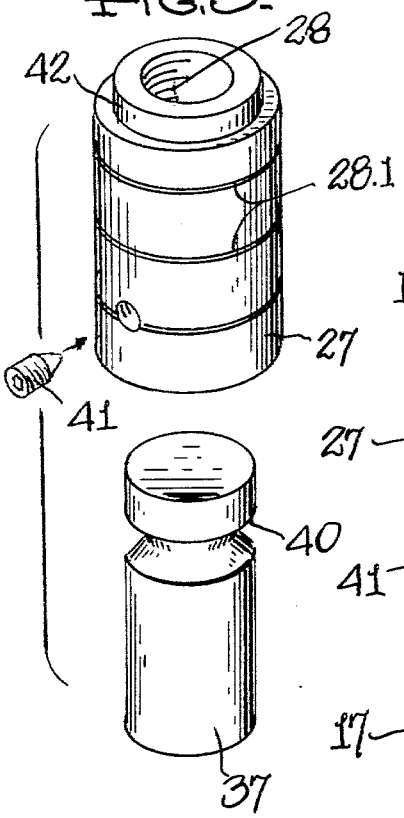
FIG. 3 is an enlarged, separated perspective view of certain parts.

The punch 37 may be assembled with the punch holder slide 27, and the latter assembled with the coil spring 33 and stripper bolt 30, all as a unit away from the C-shaped body 10, and this facilitates production-line assembly. To assemble such unit with the body, it is merely necessary to insert the punch slide holder 27 into the opening 15 and install the key 43. The coil spring 33 need not be compressed in the position shown in FIG. 3.

I claim:

1. A piercing unit for punching a hole in a strip, comprising:

a metal body having a side gap into which said strip is entered flatwise for piercing purposes, said gap being defined at least in part by overlying top and bottom body legs, said legs having a vertical hole drilled entirely through the top leg and partway through the lower leg to leave an interior shoulder in the latter, a die sleeve closely disposed within the hole in said lower leg, having its lower end bearing against said shoulder to back up said die sleeve during punching operations, said die sleeve having its upper end in line with or slightly above the upper surface of said lower leg, a punch holder slide slidable with close tolerance through the hole in said upper leg, a stripper bolt having a lower threaded end of a diameter less than the shank of said bolt to provide a shoulder therebetween, said bolt threaded end being threaded into an opening in the upper end of said punch holder slide until said bolt shoulder abuts said upper end of said punch holder slide to back up the same during punching operations, said stripper bolt having an upper abutment and a stripper spring between said bolt abutment and the upper surface of said top leg, and a punch carried by said punch holder slide for cooperation with said die sleeve, whereby with said body held stationary and downward force applied to said bolt abutment, said punch holder slide is depressed to move said punch downward through the strip disposed in said side gap and into said die holder sleeve to punch a hole in said strip.

2. The construction according to claim 1 wherein said punch holder slide has a punch-receiving opening extending inwardly from its lower end, and said punch being seated within such opening.

3. The construction according to claim 2 wherein said punch holder slide has a threaded hole extending transversely from its outer periphery to said punch-receiving opening, and a set screw threaded into such threaded hole and engageable with said punch to hold the latter assembled with said punch holder slide.

4. The construction according to claim 2 wherein said punch is formed with an annular groove and said punch holder slide has a pair of threaded holes extending transversely from its outer periphery to said punch-receiving opening in line with said annular groove when said punch is seated within said punch-receiving opening, and a set screw in each threaded hole and seating within said annular groove to hold said punch assembled with said punch-holder slide.

5. The construction according to claim 4 wherein the inner end of said punch abuts the inner extremity of the threaded end of said stripper bolt to back up said punch during punching operations.

6. The construction according to claim 1 wherein a key is removably connected to said body upper leg and has a portion engageable with said punch holder slide to prevent the latter from being withdrawn from said drilled hole.

7. The construction according to claim 1 wherein said punch holder slide has an annular undercut at its upper end to form an upwardly-facing shoulder, and wherein the upper surface of said top leg has a shallow recess extending transversely of said drilled hole and communicating with the same, and a flat key seated in said shallow recess and held in position by a machine screw threaded into said top leg, said key having an end overlying said upwardly-facing shoulder and forming an abutment to prevent said punch holder slide from being withdrawn from said drilled hole.

* * * * *